US012780487B2

(12) United States Patent
Chen et al.

(10) Patent No.: US 12,780,487 B2
(45) Date of Patent: Nov. 3, 2026

(54) SUPPORTING STRUCTURE AND PACKING BOX

(71) Applicant: Wistron NeWeb Corporation, Hsinchu (TW)

(72) Inventors: Wei Chun Chen, Hsinchu (TW); Pei Shan Yu, Hsinchu (TW); Hsiao Hsuan Huang, Hsinchu (TW)

(73) Assignee: WISTRON NEWEB CORPORATION, Hsinchu (TW)

( * ) Notice: Subject to any disclaimer, the term of this patent is extended or adjusted under 35 U.S.C. 154(b) by 661 days.

(21) Appl. No.: 18/192,814

(22) Filed: Mar. 30, 2023

(65) Prior Publication Data

US 2023/0365291 A1 Nov. 16, 2023

(30) Foreign Application Priority Data

May 10, 2022 (TW) ..... 111117553

(51) Int. Cl.
*B65D 5/42* (2006.01)
*B65D 5/20* (2006.01)
*B65D 5/30* (2006.01)

(52) U.S. Cl.
CPC ..... *B65D 5/4283* (2013.01); *B65D 5/2057* (2013.01); *B65D 5/305* (2013.01)

(58) Field of Classification Search
CPC .... B65D 5/5021; B65D 5/504; B65D 5/5007; B65D 5/5011; B65D 5/5014; B65D 5/5016
USPC ..... 206/388, 341, 327, 485, 443, 528, 589, 206/590; 229/168, 906.1
See application file for complete search history.

(56) References Cited

U.S. PATENT DOCUMENTS 3,157,275 A * 11/1964 Tolaas ..... B65D 71/125 206/780
3,378,135 A * 4/1968 Stone ..... B65D 5/5009 229/184
4,450,965 A * 5/1984 Paillet ..... B65D 5/504 206/443
4,511,042 A * 4/1985 Wischusen, III ..... B65D 5/064 229/122
5,829,587 A * 11/1998 Saiki ..... B65D 5/54 206/327

(Continued)

FOREIGN PATENT DOCUMENTS

CH 291963 A * 7/1953
FR 2347279 A2 * 11/1977
JP 3235936 U 1/2022

*Primary Examiner* — Corey N Skurdal
(74) *Attorney, Agent, or Firm* — McClure, Qualey & Rodack, LLP

(57) ABSTRACT

A supporting structure and a packing box are provided. The supporting structure includes a plate-shaped body that has a first supporting area with at least one first through hole, a second supporting area with at least one second through hole, and a foldable area located between the first supporting area and the second supporting area. The first through hole includes a supporting portion and a passage portion in communication with the supporting portion and the second through hole. The first supporting area and the second supporting area are folded relative to each other along the foldable area so as to form an accommodating space between the first through hole and the second through hole.

18 Claims, 12 Drawing Sheets

(56) References Cited

U.S. PATENT DOCUMENTS

| | | | | |
|---|---|---|---|---|
| 7,735,649 | B2 * | 6/2010 | Kim-Gifford | B65D 5/504<br>206/499 |
| 7,810,640 | B2 * | 10/2010 | Weston | B65D 5/5023<br>206/483 |
| 2014/0312109 | A1 * | 10/2014 | Weston | B65D 5/6655<br>229/120.08 |

* cited by examiner

SUPPORTING STRUCTURE AND PACKING BOX

RELATED APPLICATIONS

This application claims priority to Taiwan Application Serial Number 111117553, filed May 10, 2022, which is herein incorporated by reference.

BACKGROUND

Technical Field

The present disclosure relates to a supporting structure and a packing box, and more particularly, to a supporting structure and a packing box for accommodating a work piece.

Description of Related Art

Conventional packing structure for work pieces is to drill placement holes on a plate to position the work pieces or use trays with elasticity for direct placement of the work pieces. However, these structures often over take the space in the packing box or cannot effectively affix the work pieces, which causes damages to the work pieces during transportation.

In view of this, how to stably affix work pieces in a packing box while reducing the size of the related structure is indeed highly anticipated by the public and has become the goal and the direction of relevant industry efforts.

SUMMARY

According to one aspect of the present disclosure, a supporting structure includes a plate-shaped body. The plate-shaped body includes a first supporting area, a second supporting area, and a foldable area. The first supporting area includes at least one first through hole, and the at least one first through hole includes a supporting portion and a passage portion. The passage portion is in communication with the supporting portion. The second supporting area includes at least one second through hole, wherein the at least one second through hole is in communication with the passage portion of the at least one first through hole. The foldable area is located between the first supporting area and the second supporting area. The first supporting area and the second supporting area are foldable related to each other along the foldable area so as to form an accommodating space by the at least one first through hole and the at least one second through hole.

According to one aspect of the present disclosure, a supporting structure for positioning at least one work piece is provided. The at least one work piece has a head portion, and the head portion has a maximum outer diameter. The supporting structure includes a plate-shaped body. The plate-shaped body includes a first supporting area and a second supporting area. The first supporting area includes at least one first through hole, wherein a maximum diameter of the at least one first through hole is smaller than the maximum outer diameter of the head portion. The second supporting area is connected to the first supporting area and is substantially perpendicular to the first supporting area. The second supporting area includes at least one second through hole, wherein the at least one second through hole is in communication with the at least one first through hole to form an accommodating space. When the work piece is disposed in the accommodating space, the head portion of the work piece protrudes from the at least one first through hole and is positioned on the first supporting area.

According to one aspect of the present disclosure, a packing box includes a packing box main body and a supporting structure. The supporting structure is located in the packing box main body, and the supporting structure includes a plate-shaped body. The plate-shaped body includes a first supporting area and a second supporting area. The first supporting area includes at least one first through hole. The second supporting area is substantially vertically disposed in the packing box main body and is connected to the first supporting area. The second supporting area is substantially perpendicular to the first supporting area and includes at least one second through hole. The at least one second through hole is in communication with the at least one first through hole to form an accommodating space.

BRIEF DESCRIPTION OF THE DRAWINGS

The present disclosure can be more fully understood by reading the following detailed description of the embodiment, with reference made to the accompanying drawings as follows.

DETAILED DESCRIPTION

The embodiment will be described with the drawings. For clarity, some practical details will be described below. However, it should be noted that the present disclosure should not be limited by the practical details, that is, in some embodiment, the practical details is unnecessary. In addition, for simplifying the drawings, some conventional structures and elements will be simply illustrated, and repeated elements may be represented by the same labels.

It will be understood that when an element (or device) is referred to as be "connected to" another element, it can be directly connected to the other element, or it can be indirectly connected to the other element, that is, intervening elements may be present. In contrast, when an element is referred to as be "directly connected to" another element, there are no intervening elements present. In addition, the terms first, second, third, etc. are used herein to describe various elements or components, these elements or components should not be limited by these terms. Consequently, a first element or component discussed below could be termed a second element or component.

Figure 1:
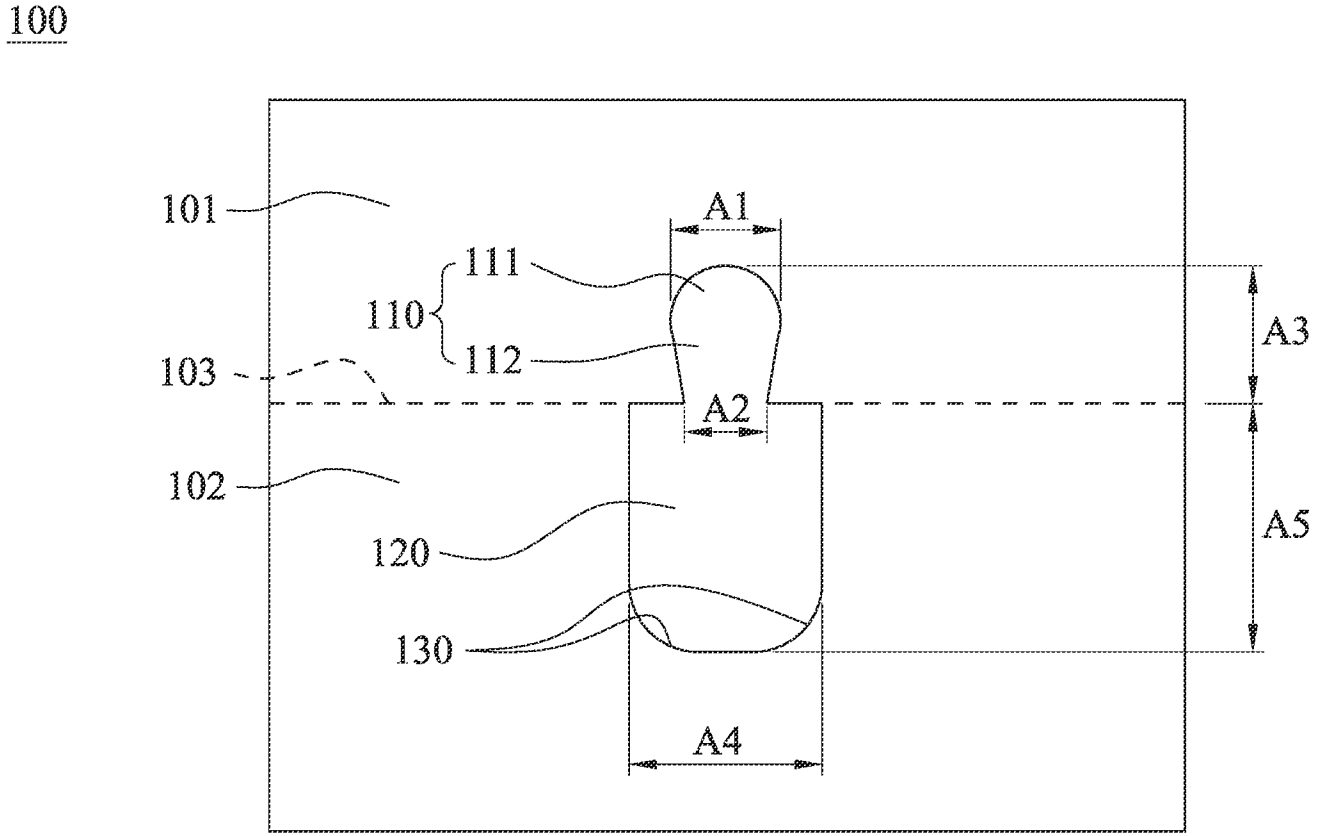
FIG. 1 is a schematic view of a supporting structure according to the 1st embodiment of the present disclosure.
Figure 2:
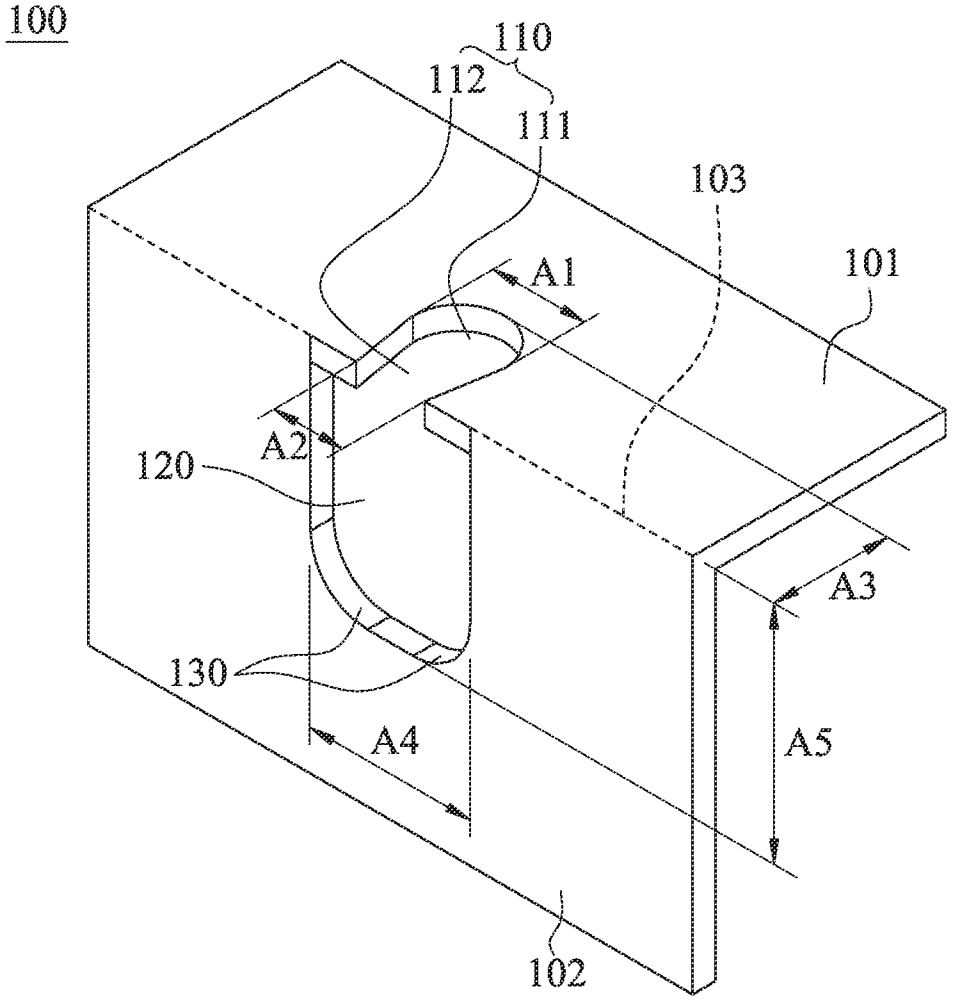
FIG. 2 is another schematic view of the supporting structure according to the 1st embodiment of FIG. 1.

References are made to FIG. 1 and FIG. 2. FIG. 1 is a schematic view of a supporting structure 100 according to the 1st embodiment of the present disclosure. FIG. 2 is another schematic view of the supporting structure 100 according to the 1st embodiment of FIG. 1. As shown in FIG. 1, the supporting structure 100 includes a plate-shaped body (reference number is omitted). The plate-shaped body includes a first supporting area 101, a second supporting area 102, and a foldable area 103. The first supporting area 101 includes at least one first through hole 110, and the first through hole 110 includes a supporting portion 111 and a passage portion 112. The passage portion 112 and the supporting portion 111 are in communication. The second supporting area 102 includes at least one second through hole 120, and the second through hole 120 is in communication with the passage portion 112 of the first through hole 110. In the embodiment of FIG. 1, a number of the first through hole 110 and a number of the second through hole 120 are both one, but the present disclosure is not limited thereto. The foldable area 103 is located between the first supporting area 101 and the second supporting area 102. As shown in FIG. 2, the first supporting area 101 and the second supporting area 102 can be folded relative to each other along the foldable area 103, and as such an accommodating space is formed between the first through hole 110 and the second through hole 120. In other words, the first supporting area 101 and the second supporting area 102 are substantially perpendicular to one another after being folded along the foldable area 103. Thus, a work piece 10 (shown in FIG. 3 and FIG. 4) can be positioned on the first supporting area 101 and accommodated in the accommodating space.

In specific, a material of the plate-shaped body of the supporting structure 100 can be a paperboard, a cardboard, or a corrugated fiberboard. If the material of the plate-shaped body is the corrugated fiberboard, the corrugated fiberboard may be characterized as G flute, F flute, E flute, B flute, C flute, A flute, BC flute, BE flute, and AB flute. In the 1st embodiment, the plate-shaped body is made of E flute. If the supporting structure 100 is made of the materials mentioned above, the foldable area 103 can be arranged on the plate-shaped body of the supporting structure 100 in a manner of puncturing or piercing by a perforation line. The foldable area 103 can also be arranged on the plate-shaped body of the supporting structure 100 by a score line, a crease line, a cutting line, or any formation, such as a combination of the score line and the perforation line so as to allow the first supporting area 101 and the second supporting area 102 to fold relative to one another. In the 1st embodiment, the foldable area 103 is formed by a way of the score line, which allows a user to fold but still provide adequate support and connection, so that the first supporting area 101 and the second supporting area 102 are unlikely to break or separate due to the folding or bending. It is to be noted that the material or manufacturing method of the present disclosure is not limited thereto. Moreover, the first supporting area 101 and the second supporting area 102 after folding are substantially perpendicular to one another, and the term "substantially perpendicular" in the present disclosure refers to the second supporting area 102 standing on a flat plane, and the first supporting area 101 can support the work piece 10 in a horizontal direction. An angle between the first supporting area 101 and the second supporting area 102 is preferably 90 degrees, but the present disclosure is not limited thereto.

As shown in FIG. 1 and FIG. 2, a diameter of the passage portion 112 of the first through hole 110 is smaller than a maximum diameter A1 of the supporting portion 111, in other words, the maximum diameter A1 of the supporting portion 111 is the largest diameter of the first through hole 110. Moreover, the diameter of the passage portion 112 of the first through hole 110 gradually decreases from the supporting portion 111 toward the foldable area 103. Hence, the work piece 10 is restricted to the supporting portion 111 due to the passage portion 112 with a smaller diameter or tapering shape, thereby preventing the work piece 10 from slipping out of the supporting structure 100 during transportation. More specifically, the passage portion 112 has a minimum diameter A2, and the following condition can be satisfied: $A2 \leq A1-2$ mm. Therefore, by the arrangement of the diameter of the supporting portion 111 and the passage portion 112 of the first through hole 110, it is favorable for providing interference so as to prevent the fallout of the work piece 10.

Figure 3:
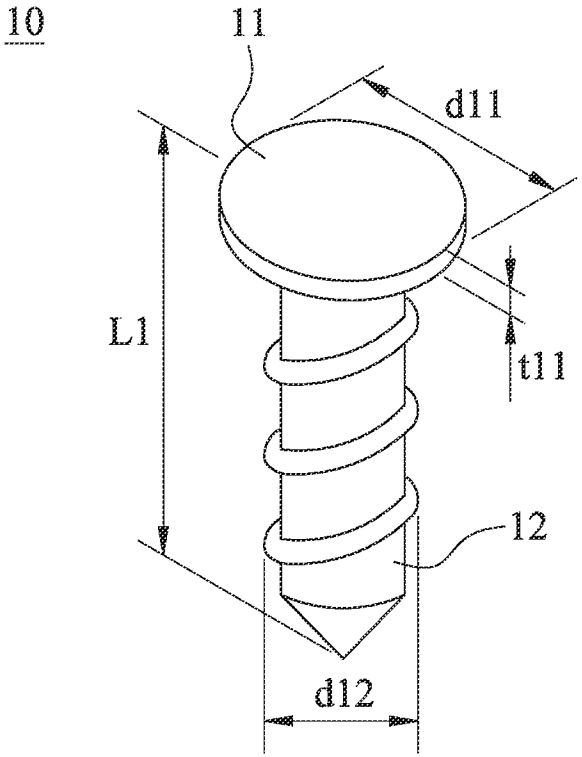
FIG. 3 is a schematic view of a work piece.
Figure 4:
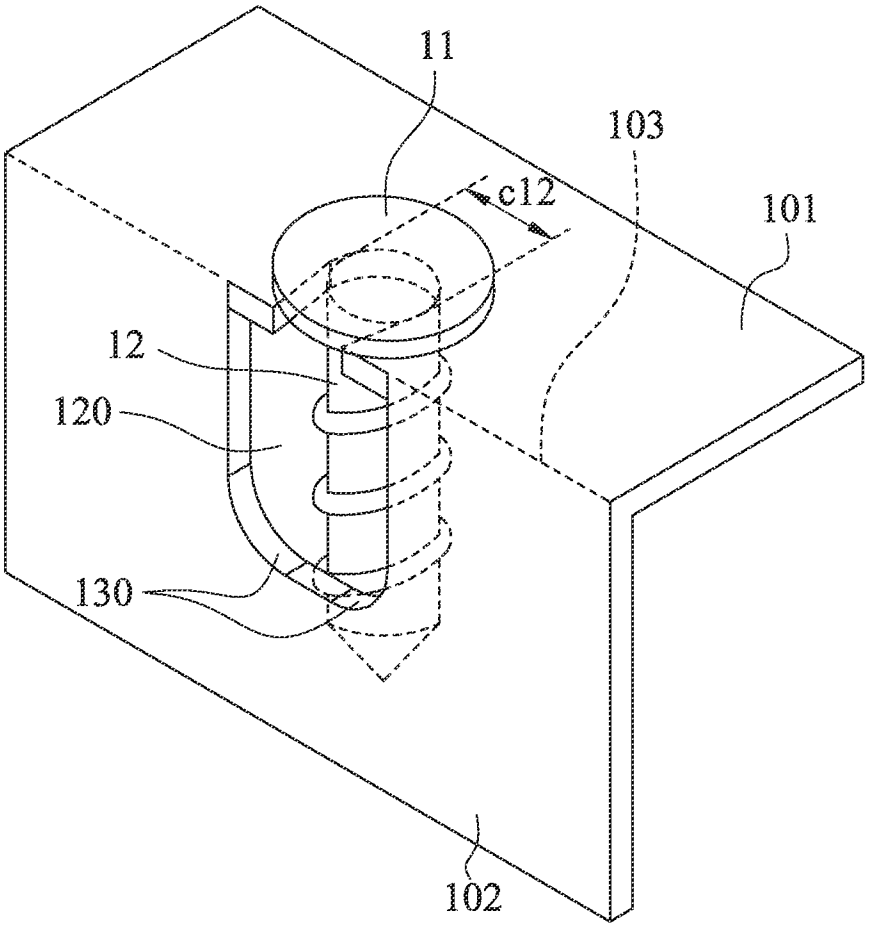
FIG. 4 is a schematic view of the supporting structure according to the 1st embodiment of FIG. 1 in use with the work piece.

References are made to FIG. 3 and FIG. 4. FIG. 3 is a schematic view of a work piece 10. FIG. 4 is a schematic view of the supporting structure 100 according to the 1st embodiment of FIG. 1 in use with the work piece 10. The work piece 10 can be placed on the supporting structure 100. As shown in FIG. 3, the work piece 10 can be a screw or a drywall anchor. The work piece 10 has a head portion 11 and a body portion 12. The work piece 10 has a total length L1, the head portion 11 has a maximum outer diameter d11 and a thickness t11, and the body portion 12 has a maximum outer diameter d12 and a central axis diameter c12 (reference number is labeled in FIG. 4). As shown in FIG. 4, the largest diameter of the first through hole 110, which is the maximum diameter A1 of the supporting portion 111, is smaller than the maximum outer diameter d11 of the head portion 11, so that the work piece 10 can be disposed in the accommodating space, and the head portion 11 of the work piece 10 can protrude from the first through hole 110 and be positioned on the first supporting area 101. It is to be noted that the supporting structure of the present disclosure can carry and accommodate any type of work piece corresponding to the actual needs, and the structure and size between the supporting structure and the work piece will be described later for better stability and positioning, but the supporting structure of the present disclosure is not limited to carry and accommodate the types and forms of work pieces described herein, nor is the size and structure of the supporting structure limited to that disclosed in the present disclosure.

In particular, the maximum diameter A1 of the supporting portion 111 and the central axis diameter c12 of the body portion 12 of the work piece 10 can satisfy the following condition: $A1=c12+1$ mm. Therefore, the work piece 10 can be taken and placed more smoothly. Furthermore, since the work piece 10 can be disposed in the accommodating space through the second through hole 120, a horizontal diameter A4 of the second through hole 120 can be greater than the maximum outer diameter d12 of the body portion 12 or be greater than the maximum diameter A1 of the supporting portion 111 of the first through hole 110 in order to enhance the convenience of taking and placing the work piece 10. Hence, the interference of the second through hole 120 can be reduced when taking and placing the work piece 10.

As shown in FIG. 1, FIG. 3, and FIG. 4, a horizontal diameter A3 of the first through hole 110 and the maximum outer diameter d11 of the head portion 11 of the work piece 10 can satisfy the following condition: A3≥d11−[(d11−d12)/2]. Therefore, when the work piece 10 is placed in the supporting structure 100, a junction of the head portion 11 and the body portion 12 of the work piece 10 can abut to a top edge of the supporting portion 111 of the first through hole 110, and the head portion 11 does not stick out of a junction of the passage portion 112 and the second through hole 120 so as to have an attractive appearance of the supporting structure 100 used with the work piece 10, and the possibility of the work piece 10 falling out or getting hit due to a protrusion of the head portion 11 can be prevented. In the embodiment of FIG. 1, the top edge of the supporting portion 111 of the first through hole 110 is arc-shaped, and it is favorable for the junction of the head portion 11 and the body portion 12 of the work piece 10 to lean and abut tightly against.

The total length L1 of the work piece 10 can be greater than a vertical diameter A5 of the second through hole 120, and the following condition can be further satisfied: A5≥L1/2. Further, the horizontal diameter A4 and the vertical diameter A5 of the second through hole 120 can satisfy the following condition: A5≥A4. By the aforementioned arrangement, half of the work piece 10 is not exposed from the second through hole 120 and is restricted behind a wall of the second supporting area 102. Therefore, the work piece 10 can be restricted in the second supporting area 102, and the work piece 10 will not easily fly out from the second through hole 120 even if the work piece 10 encountered a strong bump during transportation. Further, a length of the body portion 12, which is the total length L1 of the work piece 10 minus the thickness t11 of the head portion 11, can be greater than the vertical diameter A5 of the second through hole 120 so as to further ensure that it is not easy for the work piece 10 to fall out from the second through hole 120.

Moreover, a rounded corner 130 is disposed at each of the two ends of a bottom edge of the second through hole 120. The rounded corner 130 has a curvature R (reference number is omitted), and the following condition is satisfied: R≤A4/3. Therefore, it is favorable for a sufficient space at the bottom edge of the second through hole 120 to make the rounded corner 130, which in turn enhances the aesthetic look of the supporting structure 100.

It is to be noted that the material of the plate-shaped body of the supporting structure of the present disclosure can be a plastic material, such as polypropylene (PP), polystyrene (PS), and polyethylene terephthalate (PET). The angle between the first supporting area and the second supporting area can be directly made substantially perpendicular during the manufacturing process, and it is not limited to a manner of additional bending between the two to form the accommodating space for the work piece.

Figure 5:
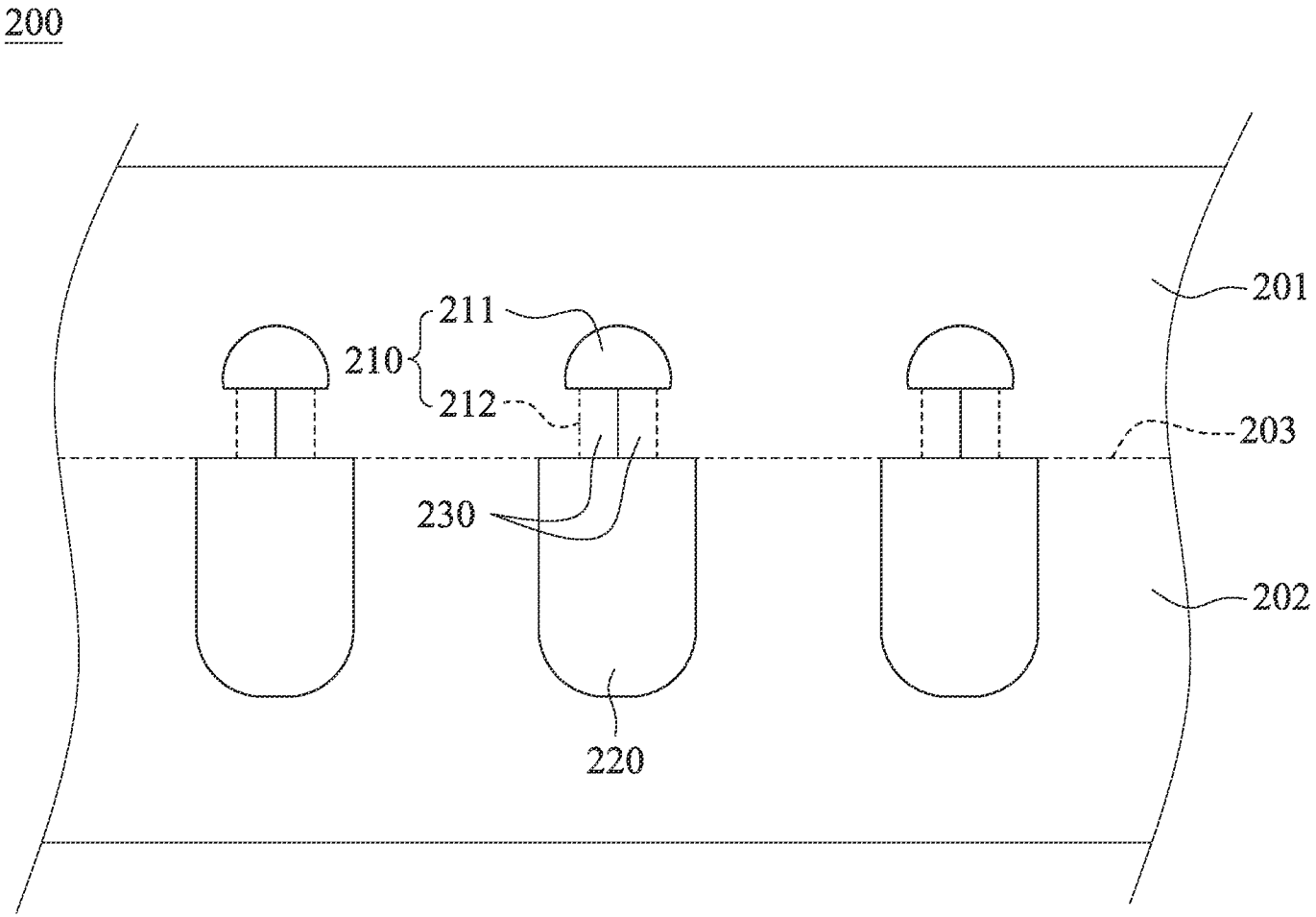
FIG. 5 is a schematic view of a supporting structure according to the 2nd embodiment of the present disclosure.
Figure 6:
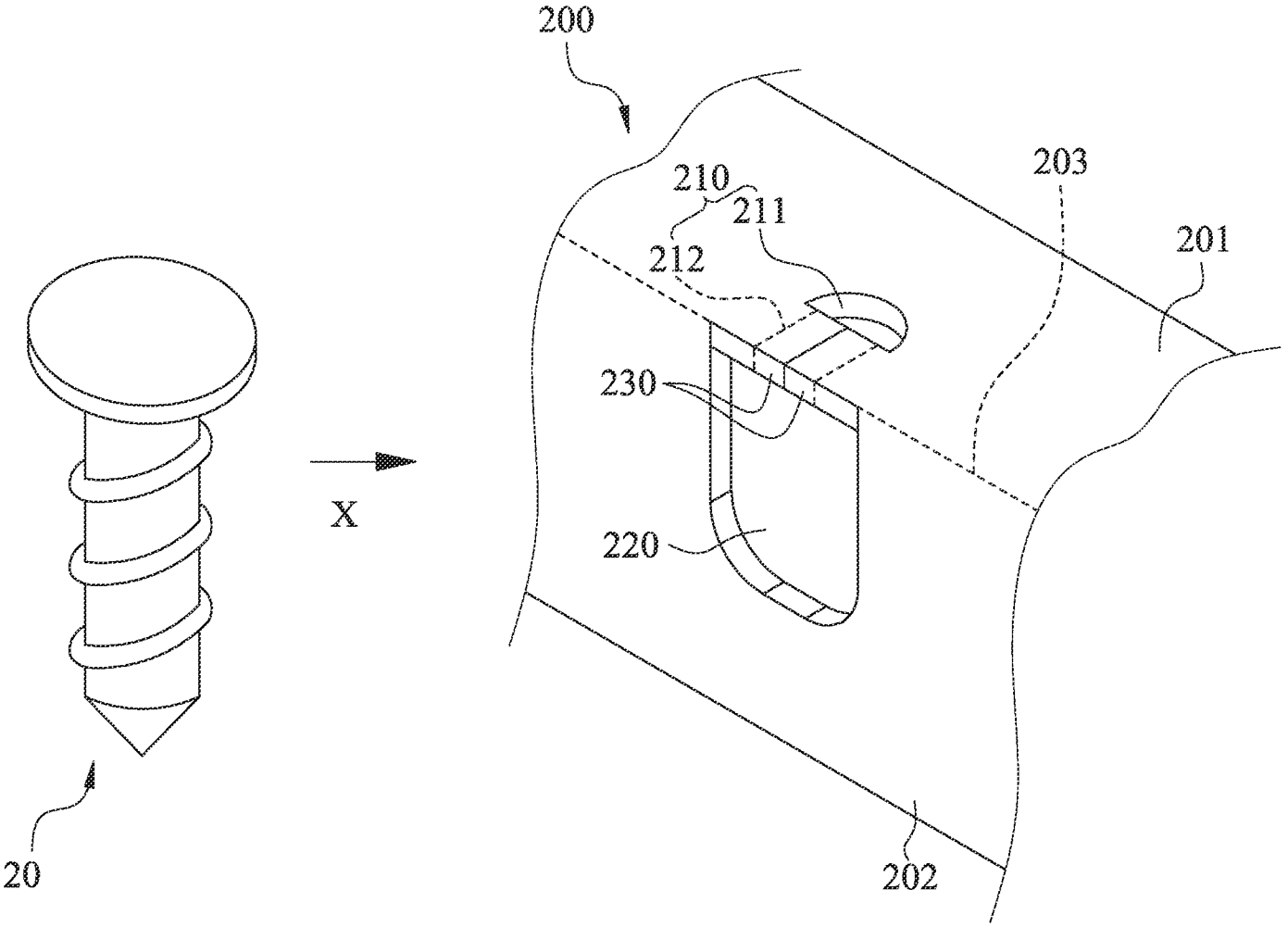
FIG. 6 is a schematic view of the installation of the supporting structure according to the 2nd embodiment of FIG. 5 and a work piece.

References are made to FIG. 5 and FIG. 6. FIG. 5 is a schematic view of a supporting structure 200 according to the 2nd embodiment of the present disclosure. FIG. 6 is a schematic view of the installation of the supporting structure 200 according to the 2nd embodiment of FIG. 5 and a work piece 20. As shown in FIG. 5 and FIG. 6, a difference between the supporting structure 200 of the 2nd embodiment and the supporting structure 100 of the 1st embodiment is that the first supporting area 201 and the second supporting area 202 include respectively three first through holes 210 and three second through holes 220. After the first supporting area 201 and the second supporting area 202 are folded relative to one another along the foldable area 203, the first through holes 210 and the second through holes 220 correspondingly form an accommodating space for accommodating the work piece 20. It is to be noted that FIG. 6 only illustrates one work piece 20 with one first through hole 210 and one second through hole 220.

As shown in FIG. 6, the work piece 20 is placed in the accommodating space through the second through hole 220, in other words, the work piece 20 is placed along a placement direction X. When a user wants to put the work piece 20 in the supporting structure 200, a tail end of the work piece 20 can be inserted into the accommodating space through the second through hole 220 that has a larger horizontal diameter (reference number is omitted), and then the work piece 20 can be put into the first through hole 210 that has a smaller diameter, so as to enhance the easiness and fluentness in placing the work piece 20 manually by the user.

In the 2nd embodiment, the first supporting area 201 can further include at least one block set, and the at least one block set includes two blocking members 230. The two blocking members 230 are respectively connected to two sides of the first through hole 210 and extend toward a center of the first through hole 210, and the two blocking members 230 are detachably connected. More particularly, the two blocking members 230 are respectively connected to two sides of the passage portion 212 of the first through hole 210 and extend toward a center of the passage portion 212. In detail, the block set is a movable structure. When the work piece 20 is put into the first through hole 210 through the passage portion 212 along the placement direction X, the blocking members 230 at the two sides of the passage portion 212 can be separated so as to let the work piece 20 enter the first through hole 210 and be positioned at the supporting portion 211. Further, the blocking members 230 are naturally closed after the work piece 20 passes through to provide a blocking effect and prevent the work piece 20 from slipping out during transportation.

In the 2nd embodiment, other structures and dispositions of the supporting structure 200 and the work piece 20 can be the same as those of the supporting structure 100 and the work piece 10 of the 1st embodiment, and will not be described again herein.

Figure 7:
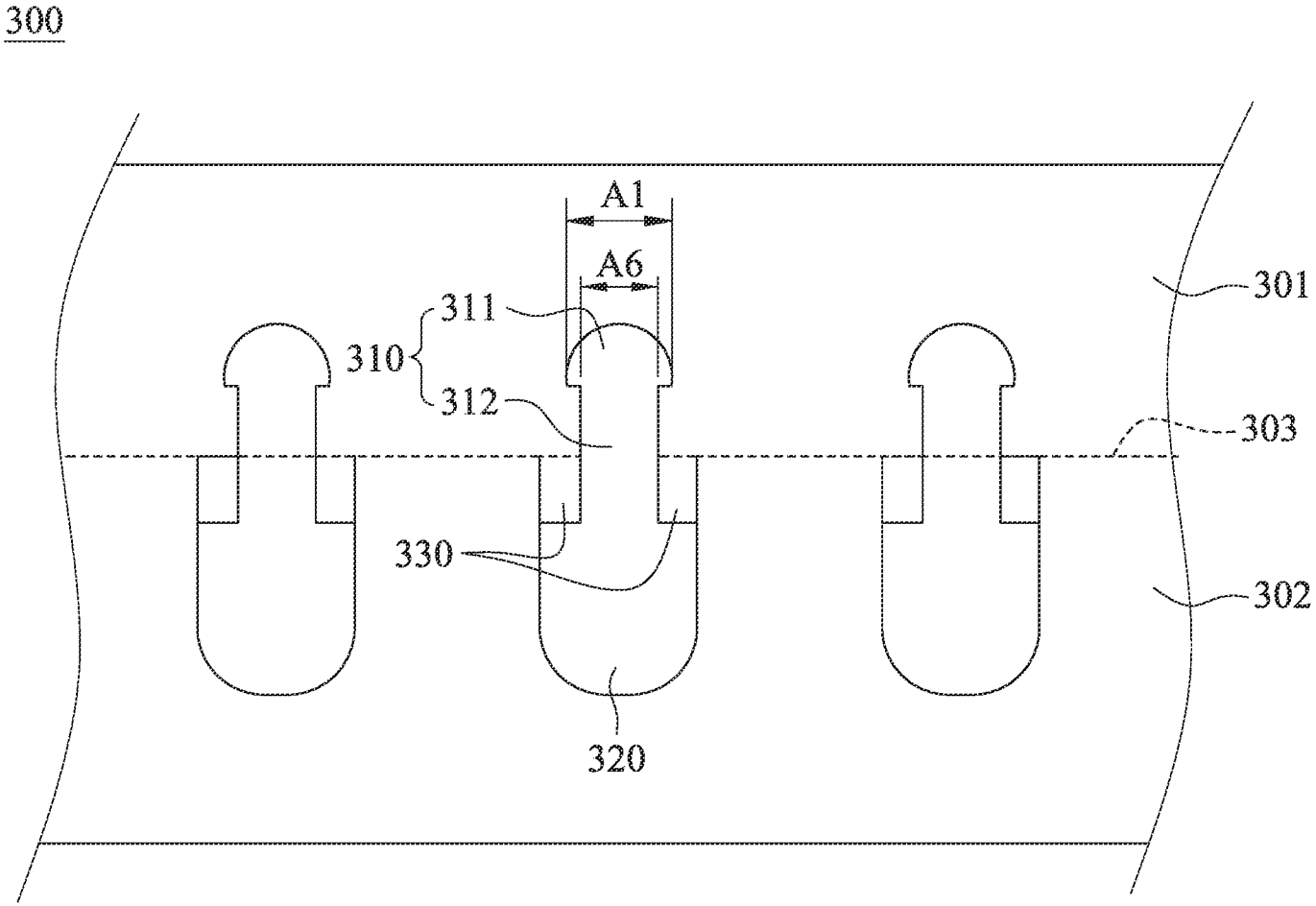
FIG. 7 is a schematic view of a supporting structure according to the 3rd embodiment of the present disclosure.
Figure 8:
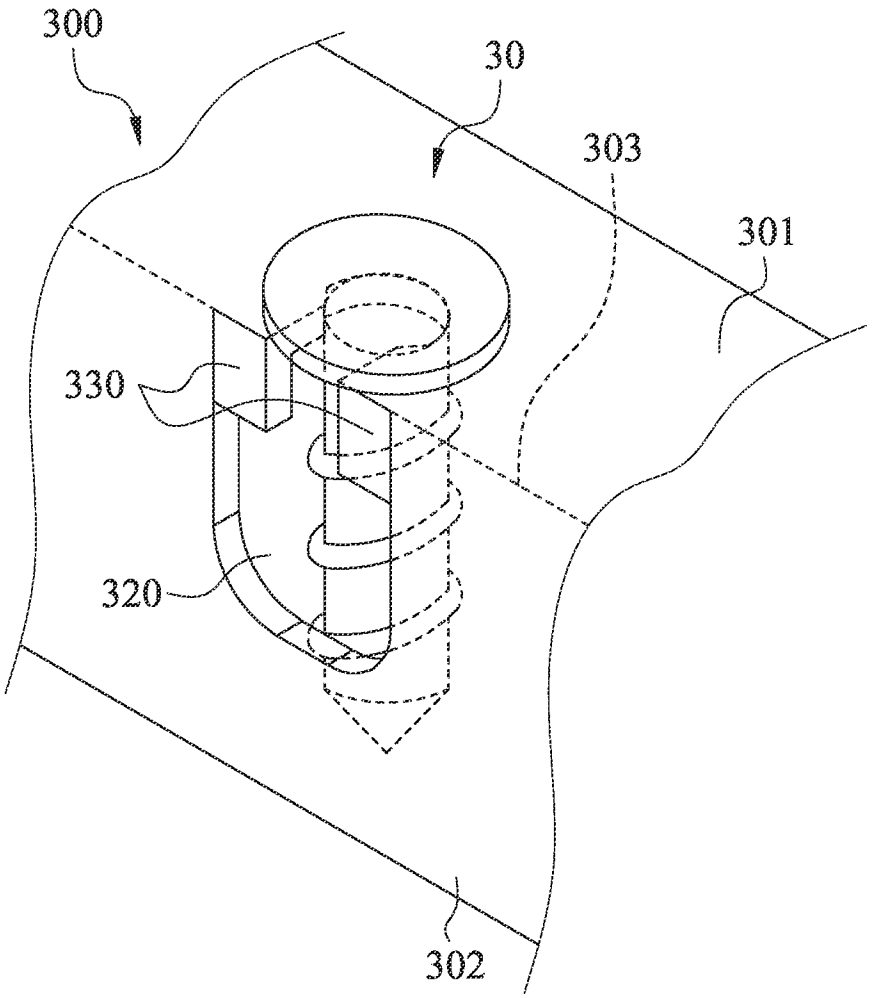
FIG. 8 is a schematic view of the supporting structure according to the 3rd embodiment of FIG. 7 in use with a work piece.

References are made to FIG. 7 and FIG. 8. FIG. 7 is a schematic view of a supporting structure 300 according to the 3rd embodiment of the present disclosure. FIG. 8 is a schematic view of the supporting structure 300 according to the 3rd embodiment of FIG. 7 in use with a work piece 30. As shown in FIG. 7 and FIG. 8, a difference between the supporting structure 300 of the 3rd embodiment and the supporting structure 100 of the 1st embodiment is that the first supporting area 301 and the second supporting area 302 include respectively three first through holes 310 and three second through holes 320. The first supporting area 301 and the second supporting area 302 are folded relative to each other along the foldable area 303 so as to form an accommodating space correspondingly by the first through holes 310 and the second through holes 320. Therefore, the work piece 30 can be accommodated in the accommodating space. It is to be noted that only one work piece 30 with one first through hole 310 and one second through hole 320 is illustrated in FIG. 8.

As shown in FIG. 7, a diameter A6 of the passage portion 312 of the first through hole 310 is smaller than the maximum diameter A1 of the supporting portion 311. In specific, the diameter A6 of the passage portion 312 does not vary between the supporting portion 311 and the foldable area 303, in other words, the passage portion 312 is a straight passage, and the diameter of the passage portion 312 is smaller than a diameter of a junction of the passage portion 312 and the supporting portion 311. As shown in FIG. 8, by the arrangement of the first through hole 310, the work piece 30 leans on the supporting portion 311 and is restricted to the first through hole 310 by the passage portion 312 after being placed in the accommodating space. Therefore, it is favorable for preventing the work piece 30 from falling out the supporting structure 300 during transportation.

The second supporting area 302 further includes a restricting wall 330 located at one side of the second through hole 320. In the embodiment of FIG. 7, a number of the restricting wall 330 of each of the second through holes 320 can be two, and the two restricting walls 330 are relatively disposed at two sides of the second through hole 320 and connected to the first supporting area 301. Thus, the restricting wall 330 can restrict the work piece 30 after the work piece 30 is placed in the accommodating space, thereby preventing the work piece 30 from slipping out the supporting structure 300.

In the 3rd embodiment, other structures and dispositions of the supporting structure 300 and the work piece 30 can be the same as those of the supporting structure 100 and the work piece 10 of the 1st embodiment, and will not be described again herein.

Figure 9:
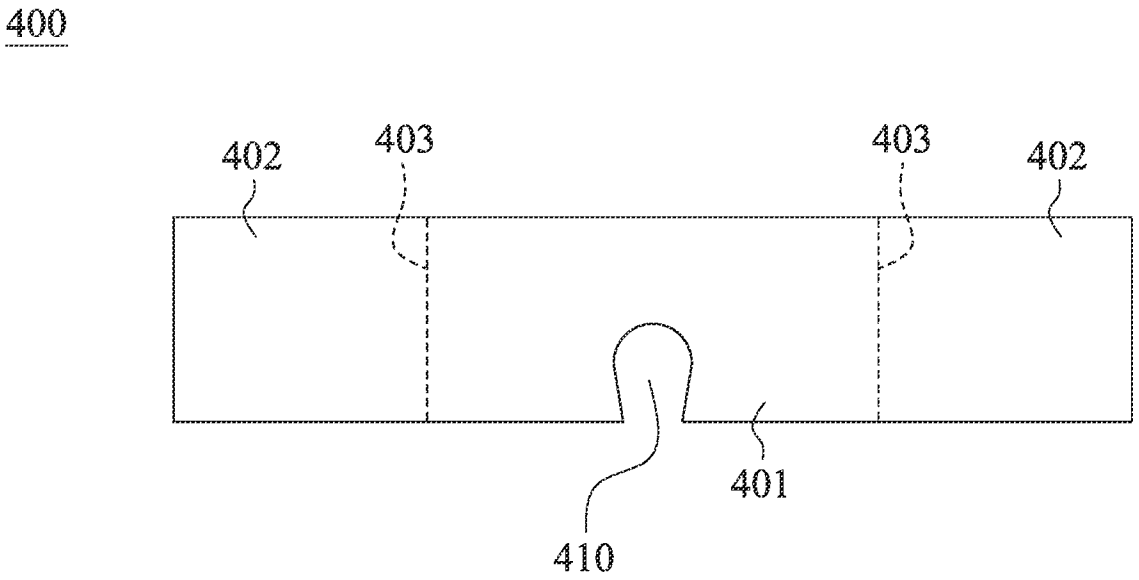
FIG. 9 is a schematic view of a supporting structure according to the 4th embodiment of the present disclosure.
Figure 10:
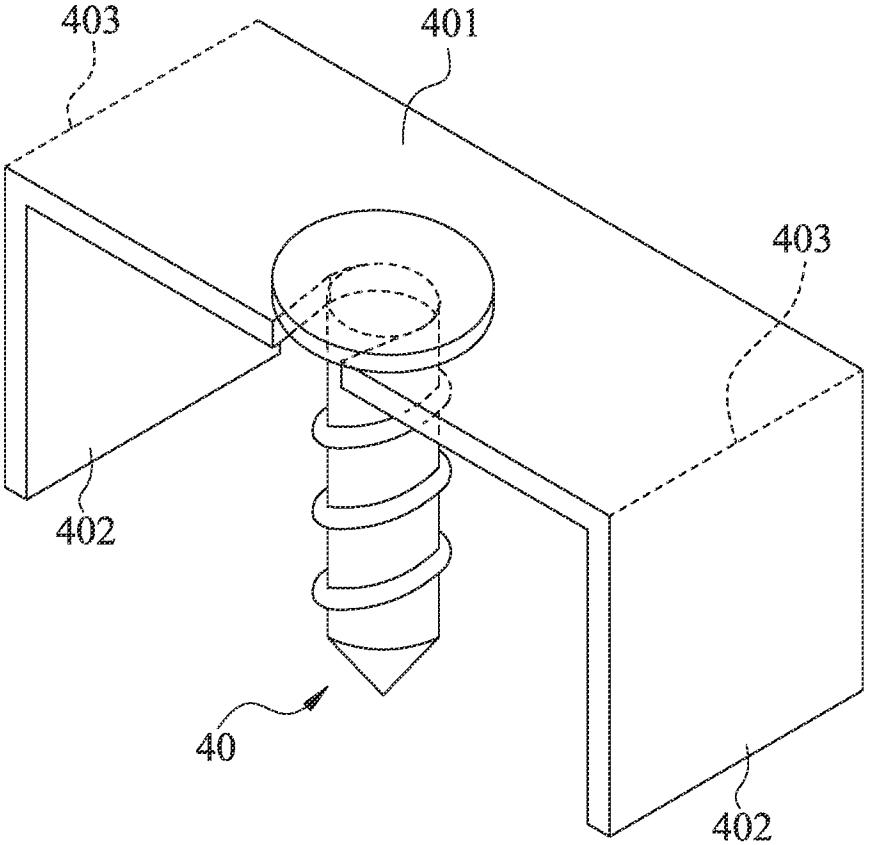
FIG. 10 is a schematic view of the supporting structure according to the 4th embodiment of FIG. 9 in use with a work piece.

References are made to FIG. 9 and FIG. 10. FIG. 9 is a schematic view of a supporting structure 400 according to the 4th embodiment of the present disclosure. FIG. 10 is a schematic view of the supporting structure 400 according to the 4th embodiment of FIG. 9 in use with a work piece 40. As shown in FIG. 9 and FIG. 10, a difference between the supporting structure 400 of the 4th embodiment and the supporting structure 100 of the 1st embodiment is that a number of the second supporting area 402 and a number of the foldable area 403 of the supporting structure 400 are both two, and the two second supporting areas 402, as well as the two foldable areas 403, are respectively connected to two sides of the first supporting area 401. After the first supporting area 401 and the second supporting areas 402 are relatively folded along the foldable areas 403, an accommodating space can be formed so as to accommodate the work piece 40 by passing the work piece 40 through the first through hole 410 of the first supporting area 401. Further, the supporting structure 400 of the 4th embodiment is favorable for cooperating with different types of packing boxes to position work pieces in the packing box so that the range of applications for the supporting structure 400 can be enhanced.

In the 4th embodiment, other structures and dispositions of the first through hole 410 of the supporting structure 400 can be the same as those of the first through hole 110 of the supporting structure 100 of the 1st embodiment, and will not be described again herein.

Figure 11:
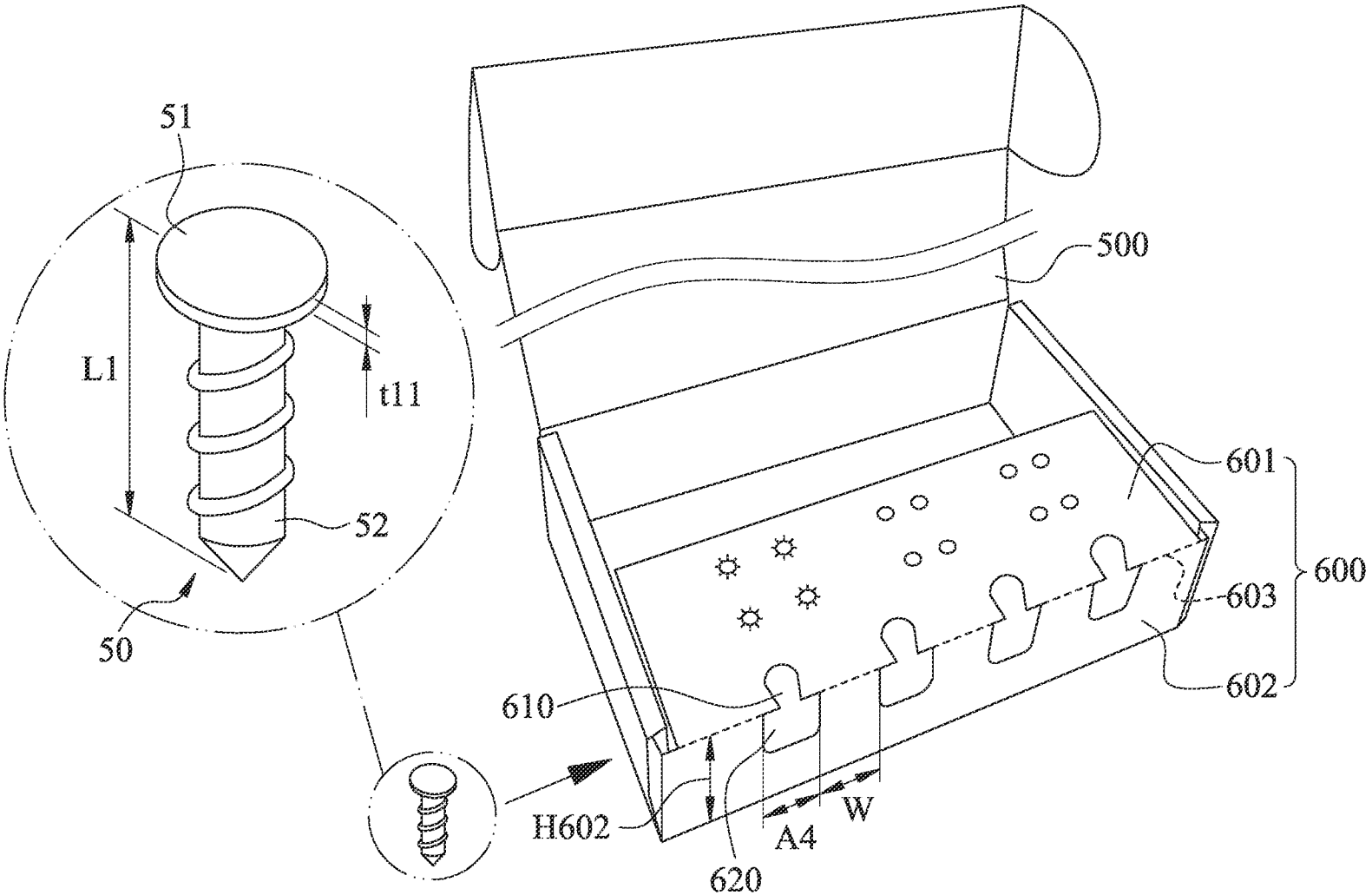
FIG. 11 is a three-dimensional schematic view of a packing box according to the 5th embodiment of the present disclosure in use with a work piece.
Figure 12:
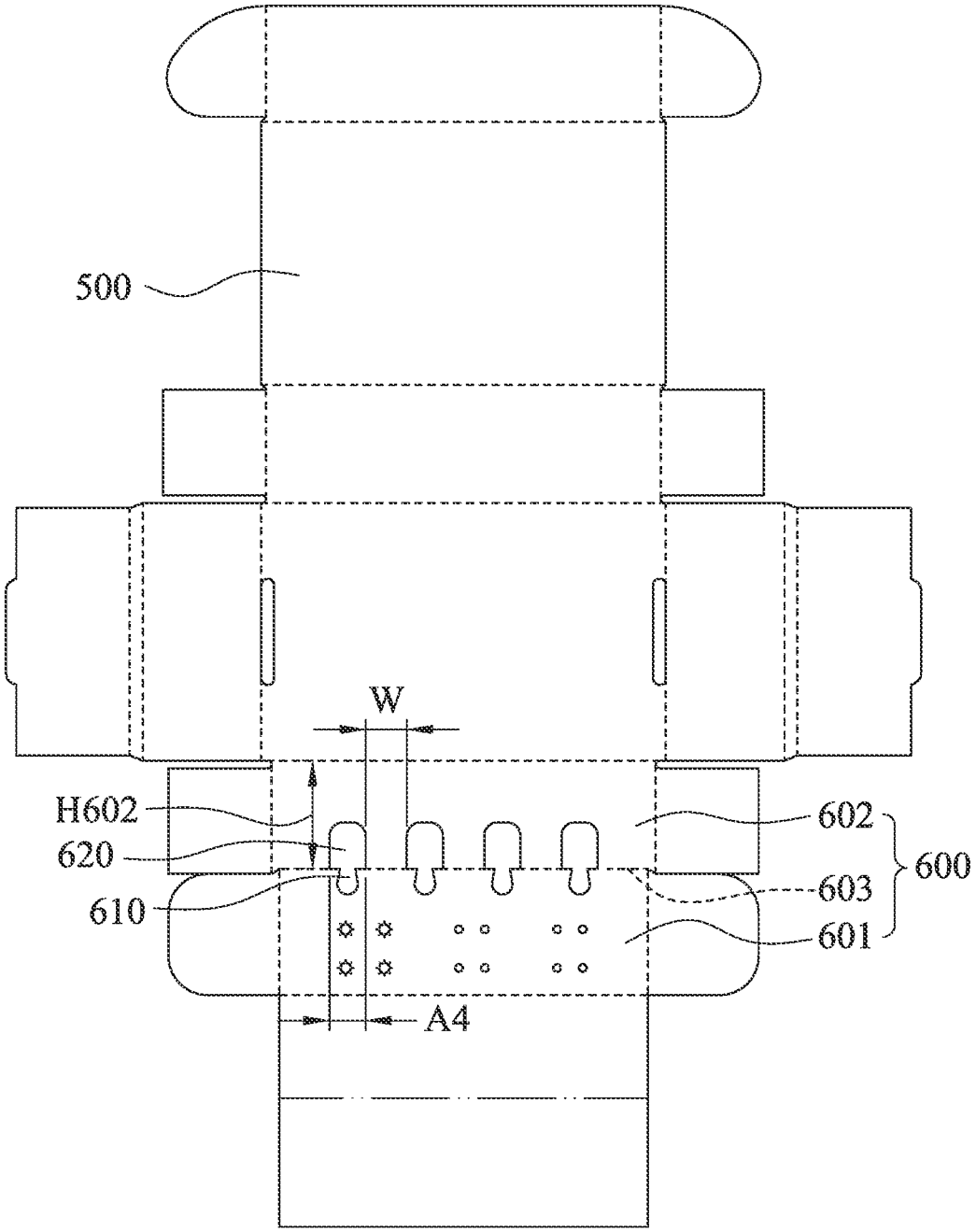
FIG. 12 is a schematic view of expanding the packing box according to the 5th embodiment of FIG. 11.

References are made to FIG. 11 and FIG. 12. FIG. 11 is a three-dimensional schematic view of a packing box according to the 5th embodiment of the present disclosure in use with a work piece 50. FIG. 12 is a schematic view of expanding the packing box according to the 5th embodiment of FIG. 11. As shown in FIG. 11 and FIG. 12, the packing box includes a packing box main body 500 and a supporting structure 600. The supporting structure 600 is disposed in the packing box main body 500, and the supporting structure 600 includes a first supporting area 601 and a second supporting area 602. In particular, the supporting structure 600 and the packing box main body 500 in the 5th embodiment can be integrally formed, and the packing box main body 500 and the supporting structure 600 can be made of foldable card paper. After folding, the packing box main body 500 has four sides, and one of the four sides is the second supporting area 602 of the supporting structure 600. The second supporting area 602 is substantially vertically disposed in the packing box main body 500 and is connected to the first supporting area 601. The term "the second supporting area 602 is substantially vertically disposed in the packing box main body 500" refers to the second supporting area 602 being disposed on and relatively vertical to a bottom side (reference number is omitted) of the packing box main box 500, so as to encircle a space with the rest of the sides of the packing box main body 500. In detail, in the 5th embodiment, an angle between the second supporting area 602 and the bottom side of the packing box main body 500 is 90 degrees.

In the 5th embodiment, a difference between the supporting structure 600 and the supporting structure 100 of the 1st embodiment is that the first supporting area 601 and the second supporting area 602 include respectively a plurality of first through holes 610 and a plurality of second through holes 620. In particular, a number of the first through holes 610 and a number of the second through holes 620 can be both four. After the first supporting area 601 and the second supporting area 602 are folded relative to one another along the foldable area 603, the first through holes 610 and the second through holes 620 correspondingly form an accommodating space for accommodating the work piece 50.

As shown in FIG. 11, there is a gap distance W between the two second through holes 620 adjacent thereto, and the gap distance W is greater than a horizontal diameter A4 of each of the second through holes 620. Hence, the structural resistance of a gap between two of the second through holes 620 adjacent thereto after being pressed is enforced, and as such the supporting structure 600 does not deform easily when the packing box is squeezed by external force, thereby preventing damages to the work piece 50 or other objects in the packing box. More particularly, the gap distance W between the two second through holes 620 adjacent thereto and the horizontal diameter A4 of the second through hole 620 can satisfy the following condition: $W \geq A4$, and the gap distance W can further satisfy the following condition: $W \geq 10$ mm. Therefore, the support provided by the supporting structure 600 upon squeezing from external force is thus enforced.

Moreover, a thickness t11 of the head portion 51 of the work piece 50, a total length L1 of the work piece 50, and a height H602 of the second supporting area 602 can satisfy the following condition: $H602 \geq L1 - t11 + 2$ mm. In other words, the height H602 of the second supporting area 602 is slightly greater than a length of the body portion 52 of the work piece 50. The length of the body portion 52 of the work piece 50 is the total length L1 of the work piece 50 minus the thickness t11 of the head portion 51. Therefore, when the work piece 50 is placed in the supporting structure 600, a tail end of the work piece 50 does not touch or come in contact with the bottom side of the packing box main body 500, which in turn prevents a risk of the bottom side of the packing box main body 500 being punctured by the work piece 50 that is falling.

In the 5th embodiment, other structures and dispositions of the supporting structure 600 and the work piece 50 can be the same as the supporting structure 100 and the work piece 10 of the 1st embodiment, and will not be described again herein.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A supporting structure, comprising:

a plate-shaped body, comprising:

a first supporting area comprising at least one first through hole, and the at least one first through hole comprising:

a supporting portion; and a passage portion being in communication with the supporting portion;

a second supporting area comprising at least one second through hole, wherein the at least one second through hole is in communication with the passage portion of the at least one first through hole; and a foldable area located between the first supporting area and the second supporting area;

wherein the first supporting area and the second supporting area are foldable related to each other along the foldable area so as to form an accommodating space by the at least one first through hole and the at least one second through hole;

wherein the first supporting area further comprises at least one block set, the at least one block set comprises two blocking members, the two blocking members are respectively connected to two sides of the passage portion and extend toward a center of the passage portion, and the two blocking members are detachably connected.

2. The supporting structure of claim 1, wherein a diameter of the passage portion is smaller than a maximum diameter of the supporting portion.

3. The supporting structure of claim 1, wherein a diameter of the passage portion gradually decreases from the supporting portion to the foldable area.

4. The supporting structure of claim 1, wherein a horizontal diameter of the at least one second through hole is greater than a maximum diameter of the supporting portion.

5. The supporting structure of claim 1, wherein the second supporting area further comprises at least one restricting wall located at one side of the at least one second through hole.

6. The supporting structure of claim 1, wherein the at least one second through hole comprises a bottom edge, and each of two ends of the bottom edge respectively comprises a rounded corner.

7. A supporting structure, which is for positioning at least one work piece, the at least one work piece having a head portion, the head portion having a maximum outer diameter, the supporting structure comprising:

a plate-shaped body, comprising:

a first supporting area comprising at least one first through hole, wherein a maximum diameter of the at least one first through hole is smaller than the maximum outer diameter of the head portion; and a second supporting area connected to the first supporting area and substantially perpendicular to the first supporting area, the second supporting area comprising at least one second through hole, wherein the at least one second through hole is in communication with the at least one first through hole to form an accommodating space;

wherein when the work piece is disposed in the accommodating space, the head portion of the work piece protrudes from the at least one first through hole and is positioned on the first supporting area;

wherein the first supporting area further comprises at least one block set, the at least one block set comprises two blocking members, the two blocking members are respectively connected to two sides of the at least one first through hole and extend toward a center of the at least one first through hole, and the two blocking members are detachably connected.

8. The supporting structure of claim 7, wherein the work piece is disposed in the accommodating space through the at least one second through hole.

9. The supporting structure of claim 7, wherein the at least one work piece comprises a body portion, the body portion comprises a maximum outer diameter, and a horizontal diameter of the at least one second through hole is greater than the maximum outer diameter of the body portion of the at least one work piece.

10. The supporting structure of claim 7, wherein the at least one work piece comprises a body portion, and a length of the body portion is greater than a vertical diameter of the at least one second through hole.

11. The supporting structure of claim 7, wherein the second supporting area further comprises a restricting wall located at one side of the at least one second through hole.

12. The supporting structure of claim 7, wherein a diameter of the at least one first through hole gradually decreases from the maximum diameter toward the at least one second through hole.

13. A packing box, comprising:

a packing box main body; and a supporting structure located in the packing box main body, and the supporting structure comprising:

a plate-shaped body, comprising:

a first supporting area comprising at least one first through hole, and the at least one first through hole comprising:

a supporting portion; and a passage portion being in communication with the supporting portion;

a second supporting area comprising at least one second through hole, wherein the at least one second through hole is in communication with the passage portion of the at least one first through hole; and a foldable area located between the first supporting area and the second supporting area;

wherein the first supporting area and the second supporting area are foldable related to each other along the foldable area so as to form an accommodating space by the at least one first through hole and the at least one second through hole;

wherein the first supporting area further comprises at least one block set, the at least one block set comprises two blocking members, the two blocking members are respectively connected to two sides of the passage portion and extend toward a center of the passage portion, and the two blocking members are detachably connected.

14. The packing box of claim 13, wherein the supporting structure and the packing box main body are integrally formed.

15. The packing box of claim 14, wherein the packing box main body comprises four sides, and one of the four sides is the second supporting area of the supporting structure.

16. The packing box of claim 13, wherein a number of the at least one first through hole and a number of the at least one second through hole are plural.

17. The packing box of claim 16, wherein there is a gap distance between two of the second through holes adjacent thereto, and the gap distance is greater than a horizontal diameter of each of the second through holes.

18. The packing box of claim 17, wherein a diameter of the passage portion is smaller than a maximum diameter of the supporting portion;

wherein the horizontal diameter of the at least one second through hole is greater than the maximum diameter of the supporting portion.

* * * * *